United States Patent [19]

Szabados

[11] 4,201,385

[45] May 6, 1980

[54] SOUND INSULATED TARGET APPARATUS WITH PROJECTILE BUTT CONTAINER

[76] Inventor: Andreas Szabados, Otto-Heilmann-Strasse 2, 8022 Grunwald b. Munich, Fed. Rep. of Germany

[21] Appl. No.: 845,380

[22] Filed: Oct. 25, 1977

[30] Foreign Application Priority Data

Oct. 25, 1976 [DE] Fed. Rep. of Germany ... 7633380[U]

[51] Int. Cl.[2] ..... F41J 1/14

[52] U.S. Cl. ..... 273/102.4; 273/102 S

[58] Field of Search ..... 273/102.4, 102 S, 102 B, 273/102 R

[56] References Cited

U.S. PATENT DOCUMENTS

| | | | |
|---|---|---|---|
| 570,820 | 11/1896 | Scratton | 273/102.4 |
| 941,642 | 11/1909 | Maxim | 273/102.4 |
| 1,260,691 | 3/1918 | McGregor | 273/102.2 R |
| 2,670,959 | 3/1954 | Broyles | 273/105.6 |
| 2,772,092 | 11/1956 | Nikoden | 273/102.4 |
| 2,812,660 | 11/1957 | Marden et al. | 273/102.4 |
| 2,813,422 | 11/1957 | Schuessler | 273/102.4 |
| 3,737,165 | 6/1973 | Pencyla | 273/102.4 |
| 3,761,085 | 9/1973 | Cook | 273/102.4 |

FOREIGN PATENT DOCUMENTS

| | | | |
|---|---|---|---|
| 858951 | 12/1952 | Fed. Rep. of Germany | 273/102.4 |
| 22013 | of 1893 | United Kingdom | 273/102.4 |
| 12728 | of 1902 | United Kingdom | 273/102.4 |
| 500372 | 2/1939 | United Kingdom | 273/102.4 |
| 815467 | 6/1959 | United Kingdom | 273/102.4 |

OTHER PUBLICATIONS

American Riflemen, Oct. 1962, p. 60, A Movable Bullet Stop.

*Primary Examiner*—Vance Y. Hum
*Assistant Examiner*—Lawrence E. Anderson
*Attorney, Agent, or Firm*—Hane, Roberts, Spiecens & Cohen

[57] ABSTRACT

A target apparatus which comprises a container and butt walls within it, the container and butt walls carrying noise deadening material whereby the target apparatus may be used close to inhabited areas or even indoors without disturbing other people owing to the noise.

1 Claim, 2 Drawing Figures

SOUND INSULATED TARGET APPARATUS WITH PROJECTILE BUTT CONTAINER

BACKGROUND OF THE INVENTION

The invention relates to a target apparatus with at least one wall which acts as a butt, and with a target which is located in front of the latter in the direction of flight of the projectile.

In shooting with air rifles or air pistols in particular, but also with small calibre weapons, a butt which is located behind the target and is constructed as a hopper-shaped box of sheet steel open on one side, is generally used. In this butt box, the percussive energy of the projectiles which are composed of lead, is usually destroyed in stages. With this destruction of energy, when the projectiles strike against the walls of the butt box, there is produced a considerable impact noise which often exceeds the noises involved in firing the gun, especially when air weapons are used.

The impact noises of the projectiles on the butt, which occur intermittently, are undesirable, particularly when such a target apparatus is to be used in the immediate proximity of inhabited areas.

SUMMARY OF THE INVENTION

It is an object of the invention to reduce the noise level substantially and thereby allow use of a target apparatus adjacent inhabited areas.

The present invention provides target apparatus comprising at least one wall which acts as a butt, and means for mounting a target in front of the butt wall in the direction of flight of the projectile, the butt wall being coated with a noise deadening layer on the surface opposite that which is to be struck by the projectile.

As a result of the noise deadening coating of the butt, a reduction in noise is achieved in a simple manner, without the operational efficiency of the apparatus being detrimentally affected. Completely trouble-free shooting in inhabited areas and even indoors is consequently made possible.

By constructing the apparatus as a container, the entire outer surface can advantageously be provided with a noise deadening layer, in order to further reduce the noise. A noise deadening layer can also be fixed to the inside wall of the container for the purpose of reducing the impact noise of the entire target apparatus, especially when the butt is accommodated in a container which is open on one side.

In order to prevent the transmission of noise from the butt walls to the container, the butt walls can be fastened to the back wall of the container with an elastic noise deadening body inserted therebetween.

With the aim of catching bad shots, the container aperture can be boardered both at the top and bottom by a screen which is preferably composed of metal, in which case an illumination means can be located behind the screen.

In order to make handling and setting-up easy, the container can be provided with a carrying handle and/or a possibly detachable supporting device.

In order that an electric cable to the illuminating means shall not be exposed to the risk of damage by bad shots, a hole can be provided at the side or in the back wall of the container, which can be closed by a flap.

In order to vary the light intensity of the target illumination, a voltage regulator can be mounted to the container.

BRIEF DESCRIPTION OF THE DRAWINGS

The invention will now be explained in greater detail by reference to an exemplified embodiment which is represented in the attached drawings.

DESCRIPTION OF THE PREFERRED EMBODIMENT

Figure 1:
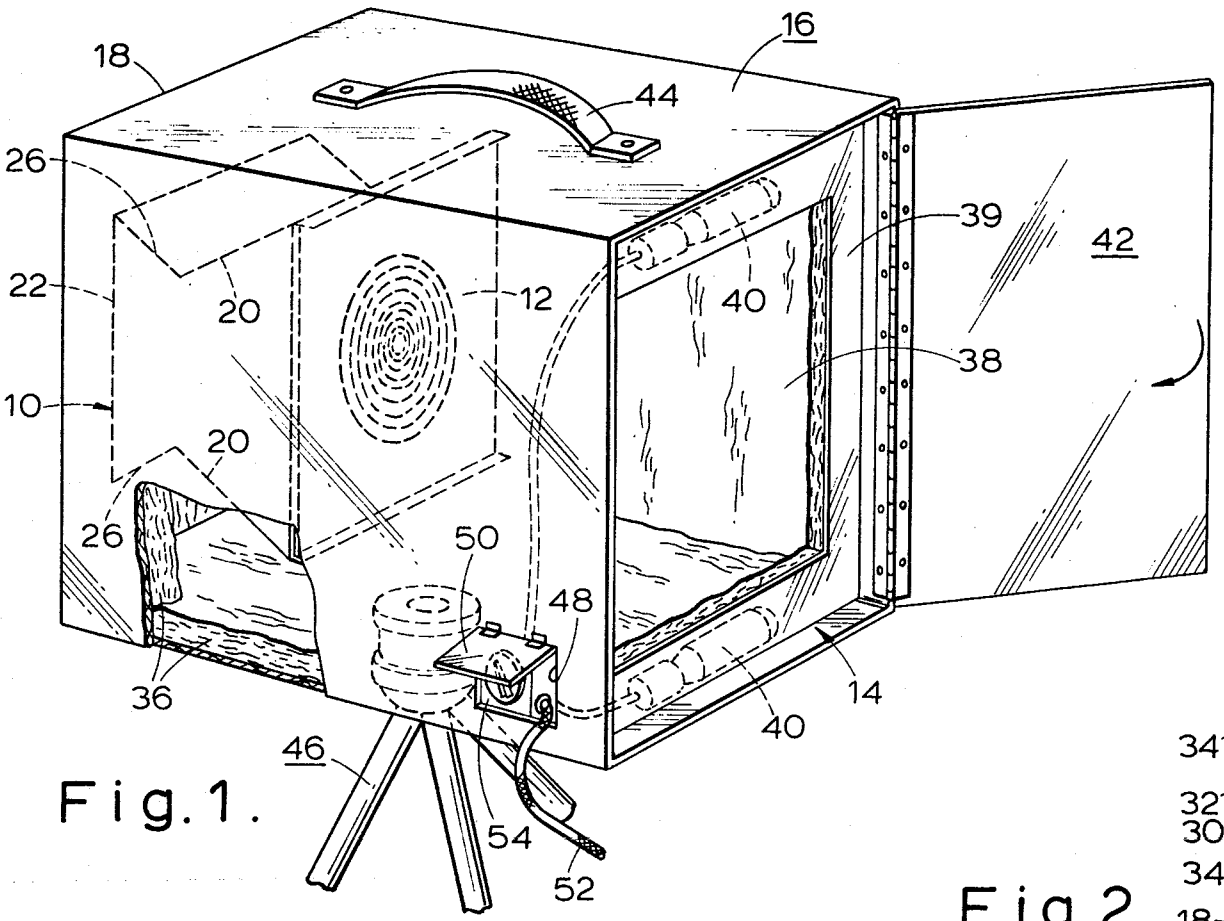
FIG. 1 shows a perspective view, partly cut away, of a target apparatus.
Figure 2:
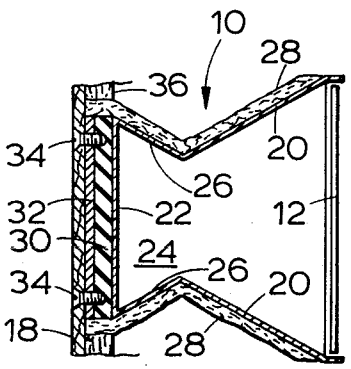
FIG. 2 shows a sectional representation through a butt and its connection to the wall of the container.

A target apparatus comprises, according to the representation in FIG. 2, of a butt 10 and, in front of the butt, a target 12, for example, a card, which is detachably fixed thereto. As is evident from FIG. 1, this target apparatus is mounted in a container preferably of steel on a back wall 18 thereof the container being provided with an aperture 14. The container provides a transportable compact unit. The butt is composed, for example, of butt walls 20 inclined to the direction of flight of the projectile, and a further butt wall 22, which is mounted to extend substantially transverse to the direction of flight of the projectile, both butt walls being connected by outwardly extending intermediate walls 26 which form a bullet-collecting space 24. Pieces of card shot from the target 12 also collect in space 24. The butt walls 20,22,26 are preferably of steel.

The entire outer surfaces of the walls 20,22 and 26 which form the butt 10 are coated with a noise deadening layer 28 preferably sealed in itself in order to prevent the impact noise which occurs when the projectiles strike the inner metal surfaces of the butt 10. The noise deadening layer 28 may be any suitable material such as solid or open or closed foam rubber, or solid or open or closed foam polymerized plastic material such as polyurethane, polystyrene, polyvinyl chloride or ureaformaldehyde resin. Such materials absorb the vibrations in the metal butt walls and prevent the back surface of the butt walls from setting up vibrations in the air which would cause a noise.

A noise deadening member 30, which can preferably be composed of rubber of laminated form is mounted over the entire surface of the butt wall 22 in order to prevent transmission of impact noise from the butt 10 to the container 16. The rubber member 30 can be vulcanized to the butt wall 22. To the side of the noise deadening body 30 opposite the butt wall 22 is mounted a mounting plate 32, with which the butt 10 is mounted on the back wall 18 of the container by means of screws 34.

A further containment of the body noise produced by the projectiles is provided by a noise deadening layer 36 on the inner walls of the container 16. These absorb impact sounds produced by the front surfaces of the butt walls and may comprise similar material to those already described as attached to the back surfaces of the butt walls.

Across the container aperture 14 there is provided a steel screen 39, which is disposed slightly towards the inside of the container, the screen 39 including a window aperture 38 through which the entire target 12 can be seen from the direction of flight of the projectile. The screen 39, which in some cases is only provided at the top and bottom and not at the sides, is provided on its inside surface with a noise deadening layer, the top and bottom parts being most important on account of the greater frequency of bad shots at the top and bottom. The screen 39 is also utilized for mounting lamps 40 for illuminating the target 12. The lamps 40 are mounted behind the screen in a way which saves space and are also safe from the projectiles. A door 42, with which the container can be closed, is hingedly mounted to one side of the container aperture 14.

A carrying handle 44 is fastened to the top of the container 16. The entire target apparatus can thus be conveniently transported and mounted on a support at any desired location. In order to increase its usefulness, a tripod 46 is fastened, preferably detachably, to the bottom of the container 16.

In order that an electric cable 52 leading from the lamps 40 to the current source shall not come into the immediate shot area, there is a hole 48 which can be closed by a flap 50, on the side or preferably at the back of the container 16.

In order to control the light intensity of the lamps 40 and therefore vary the brightness of the target, which strongly influences the accuracy and safety of the shooting, a voltage regulator 54 is mounted to the container 16.

I claim:

1. Portable target apparatus comprising: a transportable container having a top, bottom, side walls, a back and a front aperture; a butt container mounted within the transportable container for collecting spent projectiles, said butt container having upper and lower walls, a solid rear wall, a front aperture and means for mounting a target at said front aperture; connection means connecting said rear wall of the butt container to the back of the transportable container such that the front aperture of the butt container is spaced rearwardly from the front aperture of the transportable container, said connection means including a resilient layer on said rear wall of the butt container providing a connection between the inner butt container and the outer transportable container, said resilient layer also constituting an impact absorbing means and a sound deadening means for projectiles striking the rear wall of the butt container, said upper and lower walls of the butt container being V-shaped and having apices facing inwardly toward one another; sound insulation covering in entirety the outside of said walls of the butt container; and sound insulation covering in entirety the inside of the transportable container.

* * * * *